US009058000B2

(12) United States Patent
Ebihara et al.

(10) Patent No.: US 9,058,000 B2
(45) Date of Patent: Jun. 16, 2015

(54) RECORDING MATERIAL DETERMINATION DEVICE AND IMAGE FORMING APPARATUS

(75) Inventors: Shun-ichi Ebihara, Suntou-gun (JP); Norio Matsui, Mishima (JP); Shoichi Koyama, Susono (JP); Tsutomu Ishida, Suntou-gun (JP); Tomoharu Nakamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 340 days.

(21) Appl. No.: 13/179,385

(22) Filed: Jul. 8, 2011

(65) Prior Publication Data

US 2012/0020685 A1 Jan. 26, 2012

(30) Foreign Application Priority Data

Jul. 20, 2010 (JP) ..... 2010-162775

(51) Int. Cl.
*G03G 15/00* (2006.01)

(52) U.S. Cl.
CPC .. *G03G 15/5029* (2013.01); *G03G 2215/00616* (2013.01); *G03G 2215/00742* (2013.01)

(58) Field of Classification Search
CPC ..... G03G 15/00; G03G 15/5029; G03G 2215/00742
USPC ..... 399/45
See application file for complete search history.

(56) References Cited

U.S. PATENT DOCUMENTS

2009/0003857 A1* 1/2009 Kuramochi et al. ..... 399/45
2009/0310992 A1* 12/2009 Iwasa et al. ..... 399/45

FOREIGN PATENT DOCUMENTS

JP 07280636 A * 10/1995 ..... G01H 3/00
JP 10-160687 A 6/1998
JP 2009-29622 A 2/2009
JP 2009-75370 A 4/2009

* cited by examiner

*Primary Examiner* — Benjamin Schmitt
*Assistant Examiner* — Matthew Miller
(74) *Attorney, Agent, or Firm* — Canon U.S.A., Inc. IP Division

(57) ABSTRACT

A recording material determination device includes an ultrasonic wave transmission unit configured to transmit an ultrasonic wave to a recording material based on a driving signal, an ultrasonic wave receiving unit configured to receive the ultrasonic wave, a light exposure unit configured to expose the recording material to light, a light receiving unit configured to receive light, an amplification unit configured to amplify an ultrasonic wave received by the ultrasonic wave receiving unit to a first output value, and after the amplification unit amplifies the ultrasonic wave received by the ultrasonic wave receiving unit to the first output value, a control unit performs control so as to obtain the second output value by the light exposure unit and the light receiving unit during a period of time after the amplification of the ultrasonic wave is stopped and before the next ultrasonic wave comes to be transmittable.

15 Claims, 11 Drawing Sheets

RECORDING MATERIAL DETERMINATION DEVICE AND IMAGE FORMING APPARATUS

BACKGROUND OF THE INVENTION

1. Field of the Invention

The present invention relates to a recording material determination device for detecting a surface texture by capturing an image of a surface of the recording material and detecting a basis weight by an ultrasonic wave transmitted through the recording material to determine a kind of the recording material, and an image forming apparatus including the recording material determination device.

2. Description of the Related Art

In the conventional image forming apparatus, image forming conditions such as a fixing temperature and a conveyance speed of the recording material are controlled according to a kind of a recording material and an image is formed with a stable image quality independent from the kind of the recording material. Therefore, an example of the recording material determination device to determine the kind of the recording material includes a device to expose the recording material to light and determine a surface texture of the recording material, for example, based on the reflected light reflected on the recording material. Another example includes a device to expose the recording material to an ultrasonic wave and determine the basis weight of the recording material based on the ultrasonic wave transmitted through the recording material.

Japanese Patent Laid-open Publication No. 2009-29622 discusses a method for improving a determination accuracy of the recording material by a combined use of an optical-system recording material determination device and an ultrasonic wave-system recording material determination device. In Japanese Patent Laid-open Publication No. 2009-29622, in a case where the optical-system and the ultrasonic wave-system recording material determination device are combined for the use, detection processing of the respective recording material determination devices are concurrently performed where a roller is provided to pinch the recording material to avoid an interference between the ultrasonic wave-system and the optical-system recording material determination device so that no degradation of the detection accuracy of the recording material may occur. The degradation of the detection accuracy occurs when the recording material is vibrated when the detection is performed by the ultrasonic wave-system recording material determination device. Accordingly, a time taken in the detection of the recording material can be shortened.

However, although the roller enables a suppression of the interference, there is such a problem that it is hard to achieve a downsizing and cost-saving of the recording material determination device since additional members are required in order to suppress the interference between the two systems.

SUMMARY OF THE INVENTION

The invention according to the present application is directed to a recording material determination device that effectively detects a recording material without using a member for avoiding the interference.

According to an aspect of the present invention, a recording material determination device includes an ultrasonic wave transmission unit configured to transmit an ultrasonic wave to a recording material based on a driving signal, an ultrasonic wave receiving unit configured to receive the ultrasonic wave transmitted by the ultrasonic wave transmission unit, a light exposure unit configured to expose the recording material to light, alight receiving unit configured to receive light emitted by the light emission unit, an amplification unit configured to amplify an ultrasonic wave received by the ultrasonic wave receiving unit to a first output value, and a control unit configured to determine a basis weight of the recording material according to the first output value amplified by the amplification unit and determine a surface texture of the recording material according to a second output value received by the light receiving unit, wherein, after the amplification unit amplifies the ultrasonic wave received by the ultrasonic wave receiving unit to the first output value, the control unit performs control so as to obtain the second output value by the light exposure unit and the light receiving unit during a period of time after the amplification of the ultrasonic wave is stopped and before the next ultrasonic wave comes to be transmittable.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

The following exemplary embodiments do not restrict the invention recited in the scope of claims. Also, all the combinations of the features described in the exemplary embodiments are not always essential to a means for solving problems of the present invention.

Figure 1:
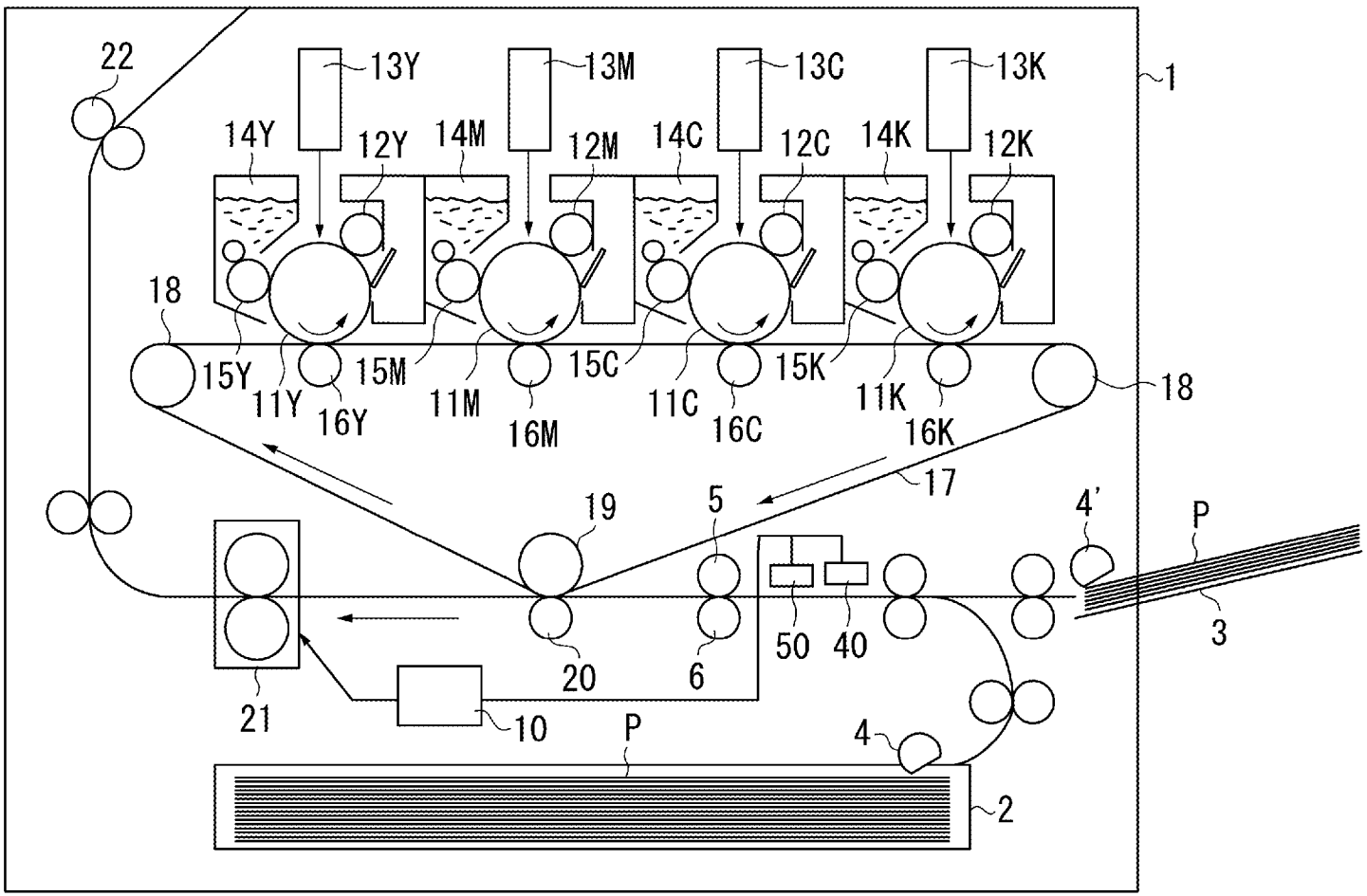
FIG. 1 illustrates a schematic configuration of an image forming apparatus.

The recording material determination device of a first exemplary embodiment can be used in an image forming apparatus, e.g., a copying machine and a printer. FIG. 1 illustrates a schematic configuration of the image forming apparatus including, as an example, an intermediate transfer belt and a plurality of image forming units positioned in parallel.

A configuration of an image forming apparatus 1 in FIG. 1 is described below. A paper feed cassette 2 stores recording materials P. A paper feed tray 3 is stacked with the recording materials P. A paper feed roller 4 feeds the recording materials P from the paper feed cassette 2. A paper feed roller 4' feeds the recording materials P from the paper feed tray 3. A conveyance roller 5 conveys thus fed recording materials P. A conveyance counter roller 6 is positioned opposed to the conveyance roller 5. Photosensitive drums 11Y, 11M, 11C, and 11K, respectively, bear developers of colors of yellow, magenta, cyan, and black. Charging rollers 12Y, 12M, 12C, and 12K, as primary charging units for the respective colors, respectively, uniformly charge the photosensitive drums 11Y, 11M, 11C, and 11K to a predetermined potential. Optical units 13Y, 13M, 13C, and 13K, respectively, expose the photosensitive drums 11Y, 11M, 11C, and 11K charged by the primary charging units to laser light corresponding to image data of the respective colors to form electrostatic latent images thereon.

Development units 14Y, 14M, 14C, and 14K, respectively, visualize the electrostatic latent images formed on the photosensitive drums 11Y, 11M, 11C, and 11K. Developing rollers 15Y, 15M, 15C, and 15K, respectively, send developers within the development units 14Y, 14M, 14C, and 14K to portions opposed to the photosensitive drums 11Y, 11M, 11C, and 11K. Primary transfer rollers 16Y, 16M, 16C, and 16K for the respective colors primary-transfer images formed on the photosensitive drums 11Y, 11M, 11C, and 11K. An intermediate transfer belt 17 carries the primary transferred image. Drive rollers 18 drive the intermediate transfer belt 17. A secondary transfer roller 19 transfers the image formed on the intermediate transfer belt 17 onto the recording material P. A secondary transfer counter roller 20 is positioned opposed to the secondary transfer roller 19. A fixing unit 21 causes a developer image transferred onto the recording material P to fuse and fix onto the recording material P while conveying it. Discharge rollers 22 discharge the recording material P after the fixing processing is performed by the fixing unit 21.

The photosensitive drums 11Y, 11M, 11C, and 11K, the charging rollers 12Y, 12M, 12C, and 12K, the development units 14Y, 14M, 14C, and 14K, and the developing rollers 15Y, 15M, 15C, and 15K, respectively, are combined according to the respective colors. A combination of the photosensitive drum, the charging roller, and the development unit is referred to as a cartridge. The cartridges of the respective colors are configured such that each cartridge can be removed from a body of the image forming apparatus with ease.

Now, an image forming operation performed by an image forming apparatus 1 is described below. Print data containing a print order and image information is input into the image forming apparatus 1 from, for example, a host computer (not illustrated). Then, the image forming apparatus 1 starts a printing operation and thus the recording material P is fed from the paper feed cassette 2 or the paper feed stray 3 by the paper feed roller 4 or the paper feed roller 4' to be sent out into the conveyance path.

The recording material P once stops at the conveyance roller 5 and the conveyance counter roller 6 to wait for the image formation to synchronize timing of the image forming operation of the image to be formed on the intermediate transfer belt 17 with timing of a conveyance of the recording material P. The recording material P is fed concurrently with the image forming operation wherein the photosensitive drums 11Y, 11M, 11C, and 11K are charged to a predetermined potential by the charging rollers 12Y, 12M, 12C, and 12K.

According to the input print data, the optical units 13Y, 13M, 13C, and 13K expose charged surfaces of the photosensitive drums 11Y, 11M, 11C, and 11K to a laser beam, scan the surfaces thereof and form electrostatic latent images. In order to visualize thus formed electrostatic latent images, development of the electrostatic latent images are performed by the development units 14Y, 14M, 14C, and 14K and the developing rollers 15Y, 15M, 15C, and 15K. The electrostatic latent images formed on the surfaces of the photosensitive drums 11Y, 11M, 11C, and 11K are developed into images of the respective colors by the development units 14Y, 14M, 14C, and 14K. The photosensitive drums 11Y, 11M, 11C, and 11K contact the intermediate transfer belt 17 to rotate in synchronization with a rotation of the intermediate transfer belt 17.

Each of the developed images is sequentially transferred onto the intermediate transfer belt 17 in a multi layered manner by the primary transfer rollers 16Y, 16M, 16C, and 16K. Then, each of the developed images is secondary transferred onto the recording material P by the secondary transfer roller 19 and the secondary transfer counter roller 20.

Subsequently, to secondary-transfer each of the developed images onto the recording material P in synchronization with the image forming operation, the recording material P is conveyed to the secondary transfer unit. The image formed on the intermediate transfer belt 17 is transferred onto the recording material P by the secondary transfer roller 19 and the secondary transfer counter roller 20. The developer image transferred onto the recording material P is fixed thereon by the fixing unit 21 including fixing rollers. The recording material P after the fixing operation is discharged to a discharge tray (not illustrated) by the discharge rollers 22. Then, the image forming operation is ended.

An ultrasonic wave-system recording material determination device 40 determines a recording material P by receiving an ultrasonic wave transmitted through the recording material P. In the present exemplary embodiment, the ultrasonic wave-system recording material determination device 40 transmits the ultrasonic wave of a frequency at 40 KHz. However, the frequency of the ultrasonic wave is not limited thereto. An optical-system recording material determination device 50 determines the recording material P by receiving reflected light reflected on the recording material P. The control unit 10 determines a kind of the recording material P based on output results of the ultrasonic wave-system recording material determination device 40 and the optical-system recording material determination device 50 to control the image forming conditions such as the fixing temperature. For the purposes of the downsizing of the device, the ultrasonic wave-system recording material determination device 40 and the optical-system recording material determination device 50 are positioned side by side.

Figure 2:
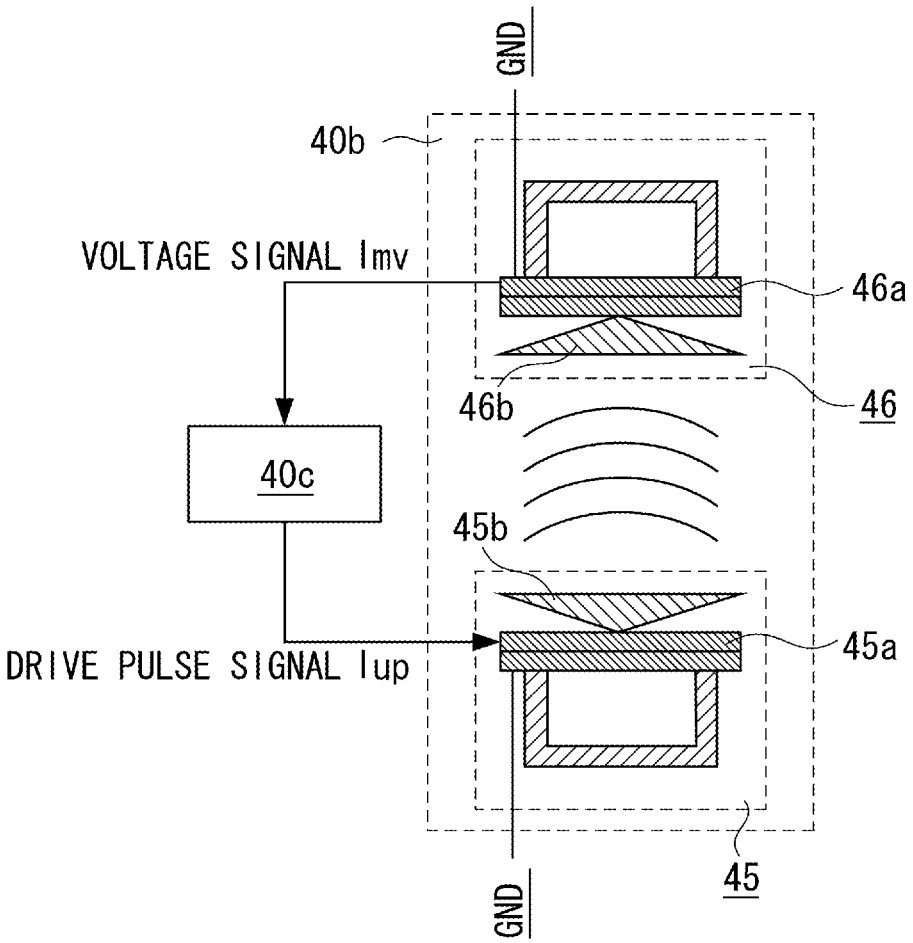
FIG. 2 illustrates a schematic configuration of an ultrasonic wave-system recording material determination device.

FIG. 2 illustrates a schematic configuration of the ultrasonic wave-system recording material determination device 40. The ultrasonic wave-system recording material determination device 40 includes a basis weight detection unit 40*b* for detecting a basis weight of the recording material P and a drive operation unit 40*c* for driving the basis weight detection unit 40*b* as well as subjecting the output signal from the basis weight detection unit 40*b* to operation processing.

The basis weight detection unit 40*b* includes an ultrasonic wave transmission unit 45 and an ultrasonic wave receiving unit 46 which are spaced at about 30 mm. When a drive pulse signal Iup is input from the drive operation unit 40*c*, the ultrasonic wave transmission unit 45 transmits an ultrasonic wave signal to the recording material P. The ultrasonic wave transmitted through the recording material P is received by an ultrasonic wave receiving unit 46. The ultrasonic wave transmission unit 45 is configured such that a corn-shaped vibration board 45*b* is mounted to a bimorph oscillator 45*a* for the purpose of enhancing a transmission power.

Figure 3:
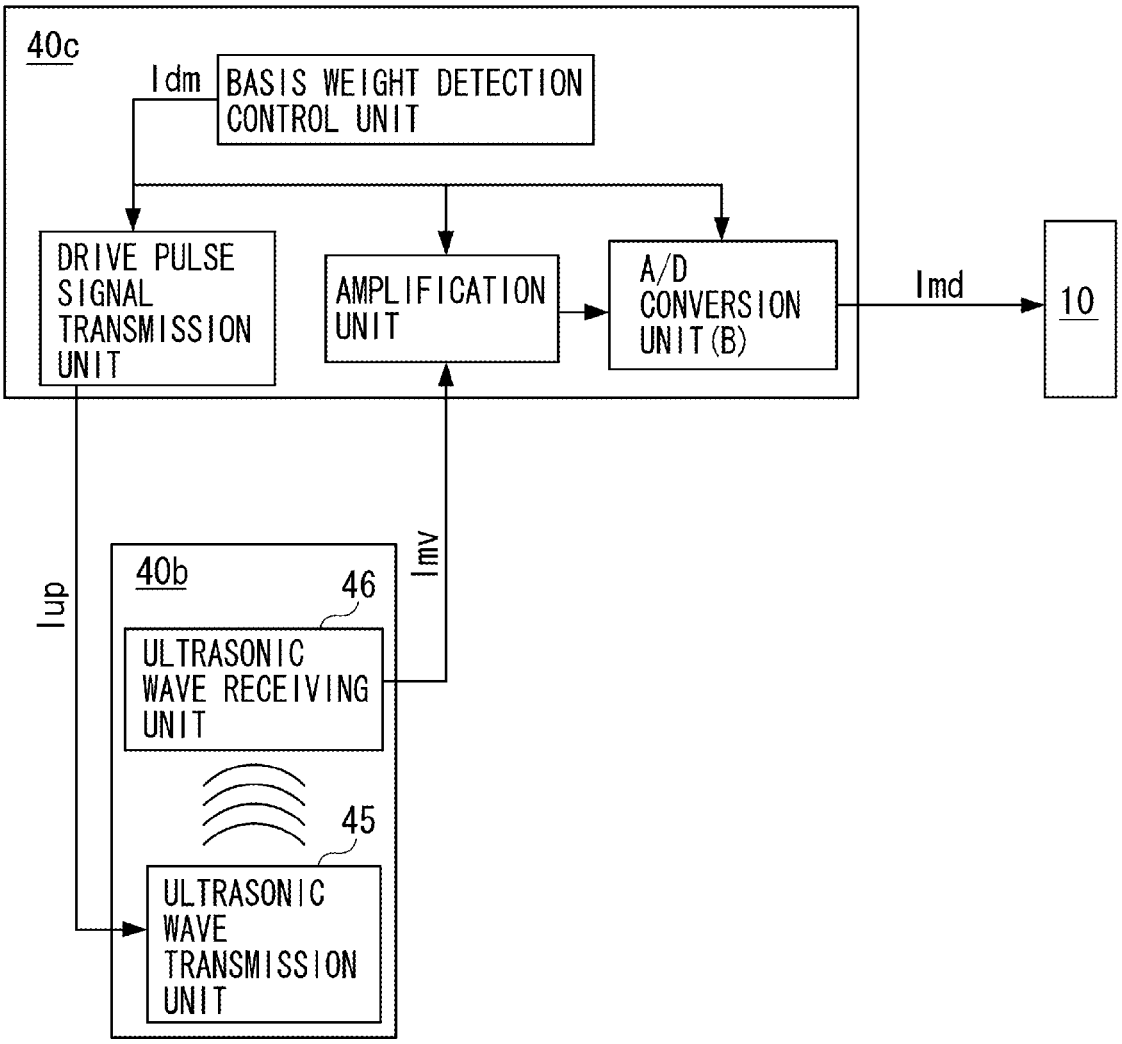
FIG. 3 is a block diagram illustrating a control system for controlling an operation of the ultrasonic wave-system recording material determination device.

FIG. 3 is an example of a block diagram illustrating a control system for controlling an operation of the ultrasonic wave-system recording material determination device 40. The drive operation unit 40*c* includes a basis weight detection control unit, a drive pulse signal transmission unit, an amplification unit, and an A/D conversion unit (B). When an instruction signal Idm from the basis weight detection control unit is turned ON, the drive pulse signal transmission unit outputs a drive pulse signal Iup. The drive pulse signal Iup is exemplified by a square wave of a frequency at 40 KHz and P-P voltage of 5V. According to the drive pulse signal Iup, the ultrasonic wave transmission unit 45 transmits the ultrasonic wave at 40 KHz to the recording material P . In the present exemplary embodiment, as an example, the ultrasonic wave transmission unit 45 is configured to transmit the ultrasonic wave signal at 40 KHz. However, the configuration of the ultrasonic wave transmission unit 45 is not limited to the above and any configuration having the ultrasonic wave of a certain frequency can be used as long as the configuration can acquire information reflecting the basis weight of the recording material P. However, if the frequency is too high, an attenuation of a sound pressure in the air or on the recording material P becomes larger, so that the attenuation results in being an obstacle in determining the recording material P. Therefore, specifically a frequency bandwidth of the ultrasonic wave at about a range between 20 KHz and 300 KHz can be used.

The ultrasonic wave receiving unit 46 is positioned opposed to the ultrasonic wave transmission unit 45 across the conveyance path of the recording material P. The ultrasonic wave receiving unit 46 receives the ultrasonic wave transmitted through the recording material P. The ultrasonic wave receiving unit 46 is configured with the corn-shaped vibration board 46*b* mounted to the bimorph oscillator 46*a*, similar to the ultrasonic wave transmission unit 45,to enhance the receiving sensitivity. Accordingly, the ultrasonic wave receiving unit 46 outputs a voltage signal Imv that changes in response to an intensity of the received ultrasonic wave. The ultrasonic wave transmitted through the recording material P is attenuated depending on the basis weight of the recording material P.

When the drive operation unit 40*c* receives a voltage output signal Imv output from the ultrasonic wave receiving unit 46, the drive operation unit 40*c* A/D-converts the voltage output signal Imv after amplifying it within a range of the P-P voltage of 24V and then outputs the converted digital signal Imd to the control unit 10 at a transfer rate of 48 MHz . The control unit 10 analyzes the received digital signal Imd to identify the basis weight of the recording material P and determine the kind of the recording material P. In the present exemplary embodiment, the recording material P is exposed to the ultrasonic wave twice and the control unit 10 analyzes the digital signal Imd corresponding to each of the exposures. Then, the analysis result of the two measurements is averaged to reduce the measurement error and enhance the basis weight identification accuracy of the recording material P. The number of exposures to the ultrasonic wave may not be limited to twice. The averaged result from the plurality of exposures may achieve a better accuracy in acquiring the output result.

Figure 4A:
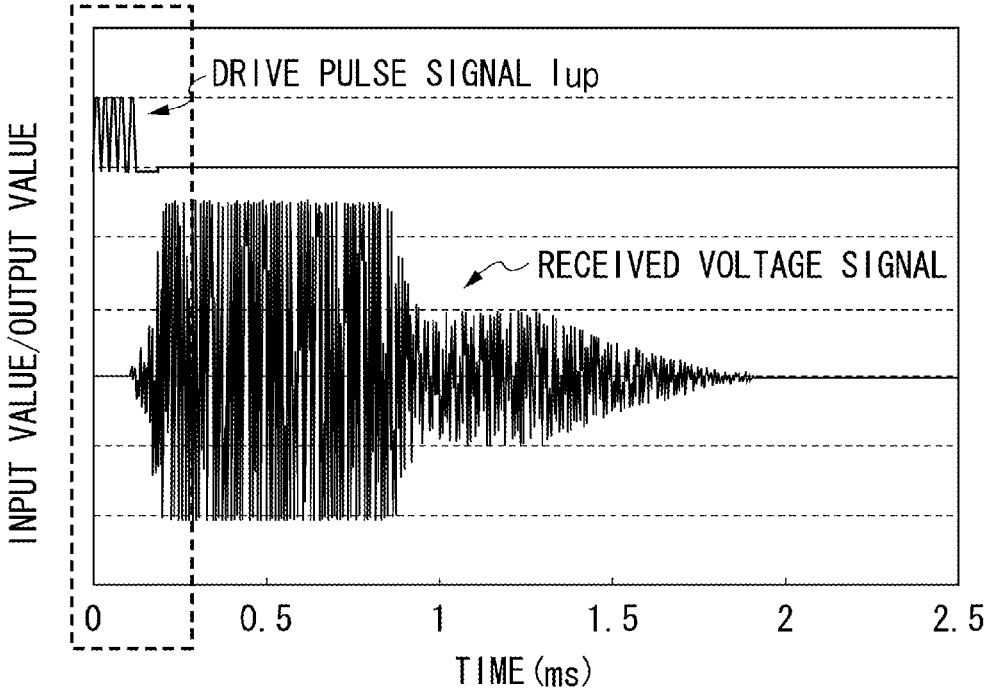
FIGS. 4A and 4B, respectively, illustrate a waveform of a drive pulse signal and a waveform of an ultrasonic wave.
Figure 4B:
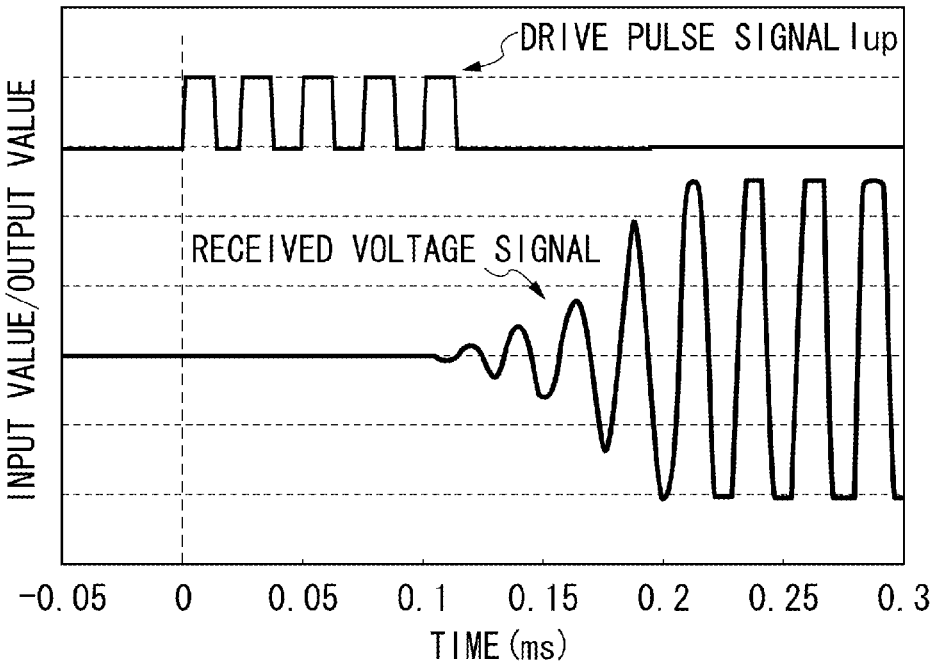

FIGS. 4A and 4B illustrate a relationship between the drive pulse signal Iup and a waveform of the ultrasonic wave. FIG. 4A illustrates a result of amplification of the voltage signal output from the ultrasonic wave receiving unit 46 when the recoding material P is exposed to the ultrasonic wave from the ultrasonic wave transmission unit 45. FIG. 4B is an enlarged view of a portion encompassed by a dotted line (i.e., between 0 ms and 0.3 ms) of FIG. 4A.

Referring to FIGS. 4A and 4B, the received wave is started to be observed about 0.1 ms after 5 waves of the drive pulse signal Iup are input. As time passes, the P-P voltage of the received wave becomes larger. In the present exemplary embodiment, the basis weight of the recording material P is identified from the maximum value of the received signal which is observed about 0.16 ms after the input of the drive pulse signal Iup. Then, the received signal after 0.2 ms has elapsed is saturated with an amplified range of 24V. A state that the received wave is attenuated after 0.8 ms has elapsed is started to be observed and the received wave is almost converged at about 2.0 ms.

More than 5 waves of the received voltage signal are observed although 5 waves of the drive pulse signal Iup are input. This is because of an effect of the reverberation of the ultrasonic wave. In a case where a plurality of detections of the basis weight of the recording material P is made, if the reverberation remains, a voltage signal Imv output from the ultrasonic wave receiving unit 46 becomes a composite signal composed of an original received signal and a reverbed signal. If the voltage signal Imv becomes the composite signal, it becomes hard to accurately determine the basis weight of the recording material P. Accordingly, when the detection is made for a plurality of times, the next ultrasonic wave is transmitted after the convergence of the output value to make the detection to prevent the effect of the reverberation from occurring. In the present exemplary embodiment, an inputting interval of the drive pulse signal Iup input to the ultrasonic wave transmission unit 45 is set to 2.5 ms to wait for a state in which the next ultrasonic wave can be transmitted after the received wave is sufficiently converged.

Figure 5:
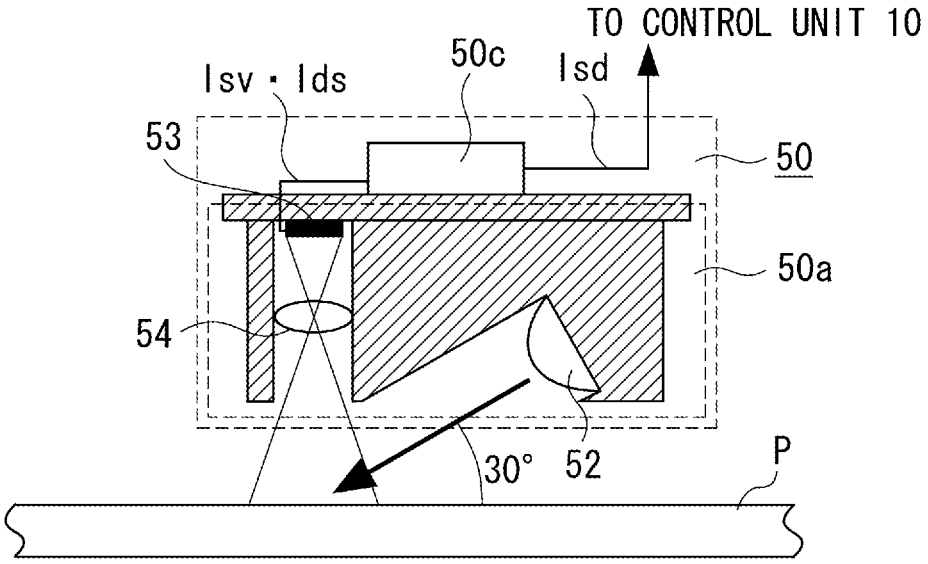
FIG. 5 illustrates a schematic configuration of the optical-system recording material determination device.

FIG. 5 illustrates a schematic configuration of the optical-system recording material determination device 50. The optical-system recording material determination device 50 includes a reflective LED 52 as a light emission unit, a CMOS area sensor 53 as an image capturing unit, an imaging lens 54 as an imaging unit, and a drive operation unit 50*c* for driving the CMOS area sensor 53 as well as processing the output signal from the CMOS area sensor 53. Here, the CMOS area sensor 53 is used as a member composing the surface detection unit; however, for example, a CCD type sensor or a line sensor may also be used.

Light of the reflective LED 52 as a light source is emitted to a surface of the recording material P. The reflective LED 52 is positioned to emit light to the surface of the recording material P obliquely with a predetermined angle. In the present exemplary embodiment, as an example, the reflective LED 52 is positioned such that an angle between the surface of the recording material P and an exposure direction of the LED light becomes 30 degrees. The reflected light including shading information which reflects the surface smoothness of the recording material Pis condensed via an image lens 54 to form an image onto the CMOS area sensor 53 as a light receiving unit. When the CMOS area sensor 53 receives the instruction signal Ids output from the drive operation unit 50*c*, the CMOS area sensor 53 outputs a voltage video signal Isv that changes in response to a reflected light amount for each area where the image is formed. When the drive operation unit 50*c* receives the voltage video signal Isv output from the CMOS line sensor 53, the drive operation unit 50*c* A/D-converts it and outputs thus converted digital signal Isd to the control unit 10. According to the above described operation, for example, area information of a range of 1.5 mm×1.5 mm on the surface of the recording material P can be obtained with a resolution of 600 dpi×600 dpi in the present exemplary embodiment.

Figure 6:
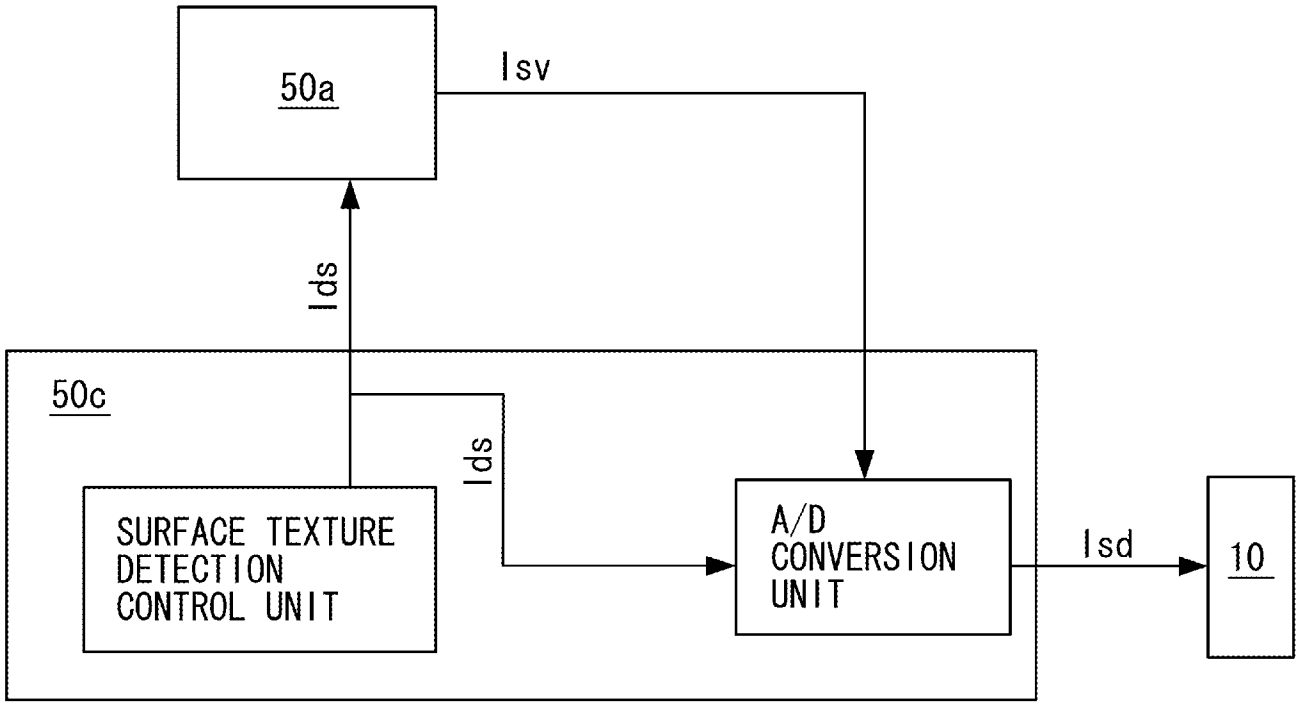
FIG. 6 is a block diagram illustrating a control system for controlling an operation of the optical-system recording material determination device.

FIG. 6 is an example of a block diagram illustrating a control system for controlling an operation of the optical-system recording material determination device 50. The drive operation unit 50*c* includes a surface texture detection control unit and an A/D conversion unit (A). When the instruction signal Ids from the surface texture detection control unit is turned ON, the CMOS area sensor 53 outputs the voltage video signal Isv that changes in response to the reflected light amount for each area where an image is formed. When the drive operation unit 50*c* receives the voltage video signal Isv output from the CMOS area sensor 53, the drive operation unit 50*c* A/D-converts it and outputs thus converted digital signal Isd to the control unit 10 at a transfer rate of 48 MHz. Then, during a period of time after the instruction signal Ids is turned OFF and before the instruction signal Ids is turned ON again, the output of the digital signal Isd is stopped. The control unit 10 analyzes the received digital signal Isd as a video, and identifies a surface condition of the recording material P.

Figure 7:
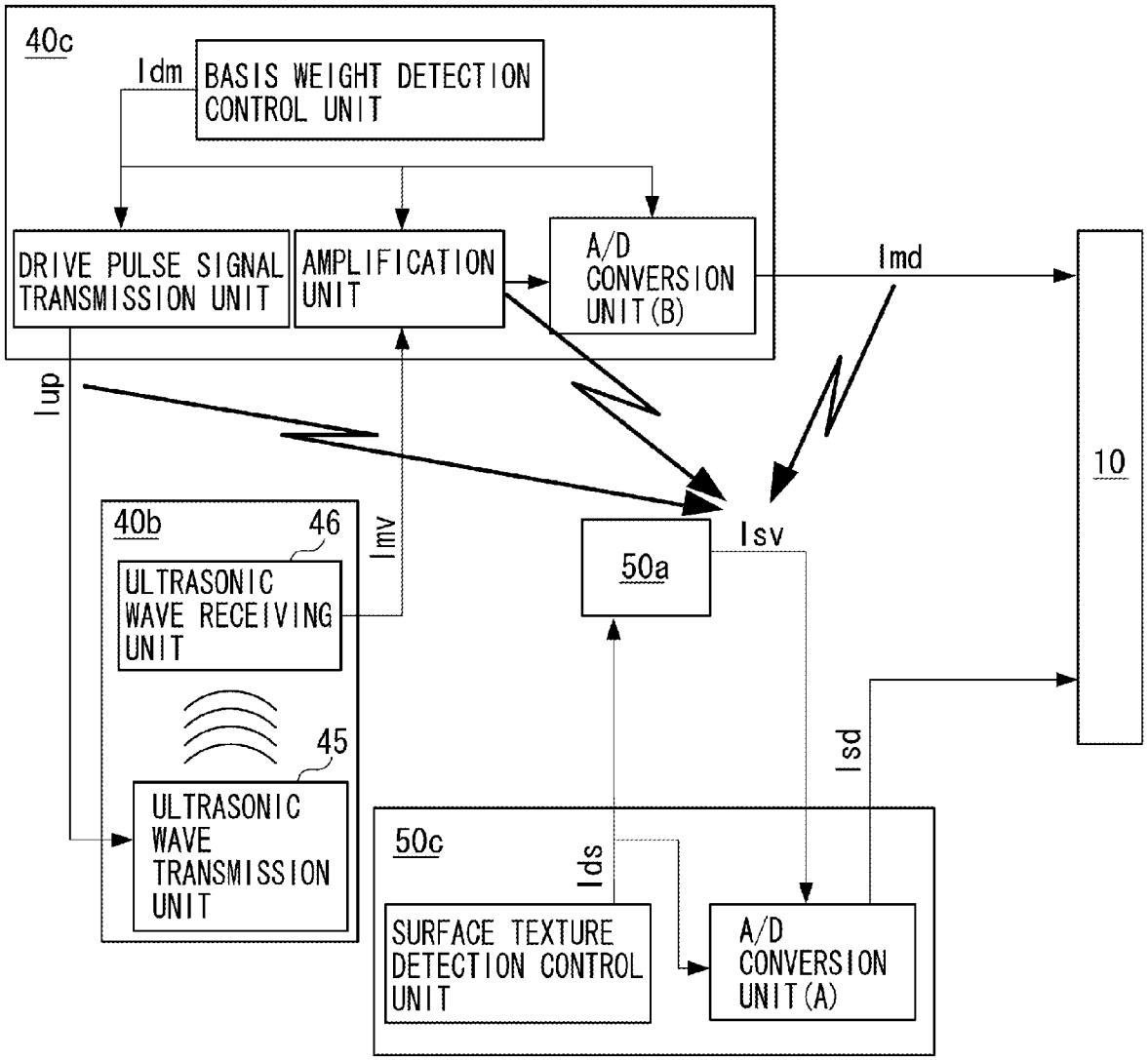
FIG. 7 is a block diagram illustrating a state that the ultrasonic wave-system recording material determination device and the optical-system recording material determination device are positioned side by side.

FIG. 7 is a block diagram illustrating a state in which the ultrasonic wave-system recording material determination device 40 and the optical-system recording material determination device 50 are positioned side by side. To downsize the recording material determination device, such a configuration is employed that the ultrasonic wave-system recording material determination device 40 and the optical-system recording material determination device 50 are positioned adjacent to each other. Therefore, an electrical circuit for controlling the voltage output is also positioned beside them. Accordingly, a detection operation performed by the electrical circuit of the one of the determination devices becomes a noise for the electrical circuit of the other one of the determination devices, which may degrade the determination accuracy of the recording material P. More specifically, the digital signal Imd output from the ultrasonic wave-system recording material determination device 40 fluctuates in voltage of 48 MHz, so that the digital signal Imd becomes a noise source for the voltage video signal Isv output from the CMOS area sensor 53 included in the optical-system recording material determination device 50. The driving signal Iup which is input into the ultrasonic wave transmission unit 45, and the voltage output signal Imv amplified after being output from the ultrasonic wave receiving unit 46 fluctuate in voltage at the frequency of 40 KHz, so that the signals may become the noise source of the voltage video signal Isv.

As described above, in the present exemplary embodiment, timing controls are performed with respect to the detection by the ultrasonic wave-system recording material determination device 40 and the detection by the optical-system recording material determination device 50 such that the determination accuracy of the recording material P is not degraded due to a noise coming from the voltage output signal. Specifically, after a basis weight detection operation is performed by the ultrasonic wave using the basis weight detection unit 40*b* in the ultrasonic wave-system recording material determination device 40, the detection is made by the optical-system recording material determination device 50 during a period of time that the reverberation of the ultrasonic wave is converged. In this case, the amplification operation and the A/D conversion in the drive operation unit 40*c* are stopped after predetermined time (0.3 ms) has elapsed after the drive pulse signal Iup is output such that the reverb signal output from the ultrasonic wave receiving unit 46 does not apply a noise to the voltage video signal Isd in the surface texture detection. Accordingly, since the output of the voltage signal output from the amplification unit to the A/D conversion unit of the drive operation unit 40*c* is suppressed, the amplified reverb signal can be prevented from being a noise with respect to the voltage video signal Isv. Since the output from the A/D conversion unit of the drive operation unit 40*c* is stopped, the reverb signal after the A/D conversion can be prevented from emitting the noise to the voltage video signal Isv. Accordingly, the noise to each other's detection operation and degradation of the detection accuracy of the recording material P can be suppressed.

Figure 8:
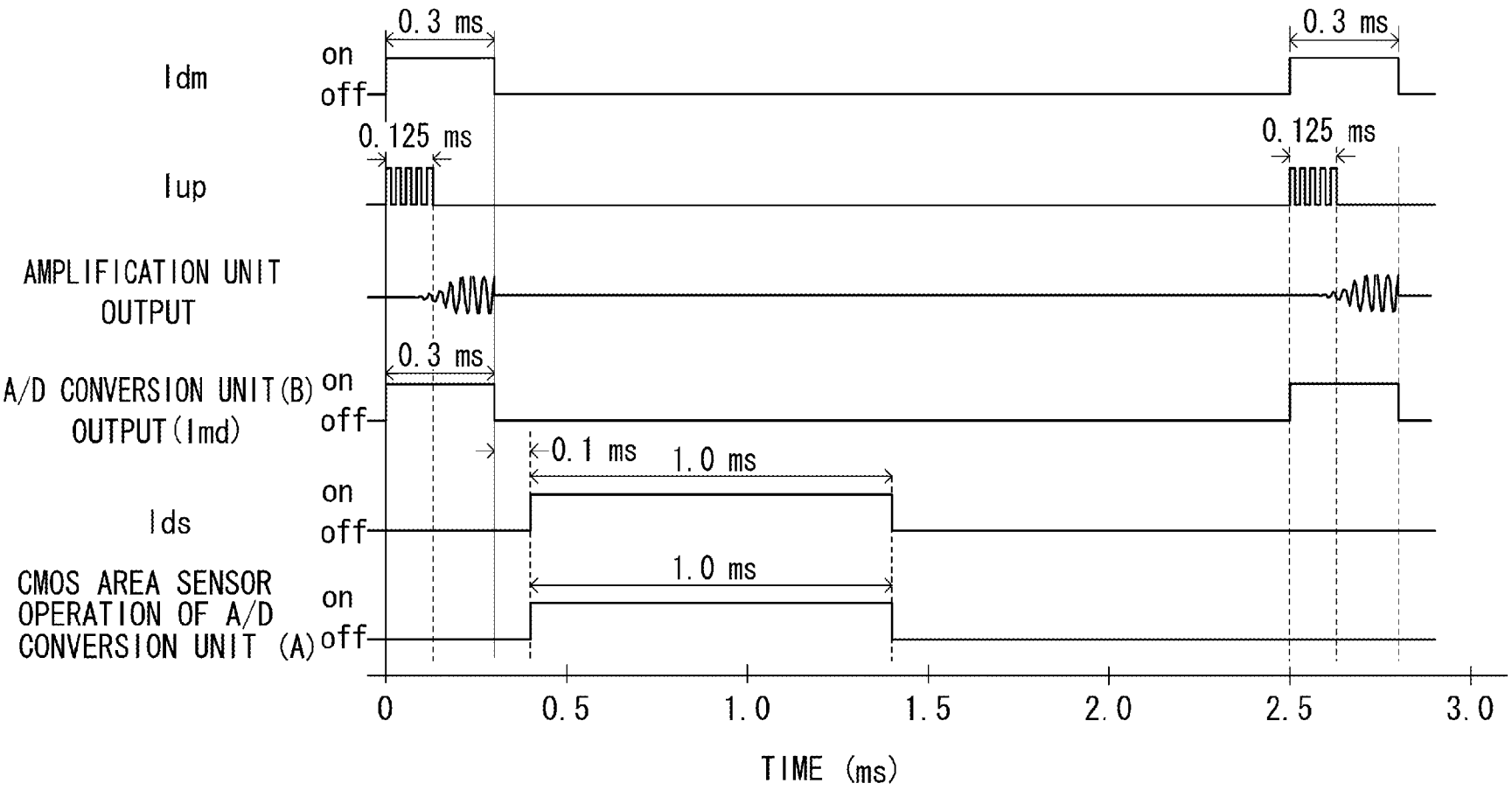
FIG. 8 is a timing chart illustrating detection timings of the ultrasonic wave-system recording material determination device and the optical-system recording material determination device, respectively, according to the first exemplary embodiment.

Detection timings of the ultrasonic wave-system recording material determination device 40 and the optical-system recording material determination device 50 are described below with reference to a timing chart of FIG. 8. At first, the detection starts using the ultrasonic wave-system recording material determination device 40. When the instruction signal Idm from the basis weight detection control unit is turned ON, 5 waves (for a period of about 0.125 ms) of the drive pulse signal Iup at 40 KHz is output from the drive pulse signal transmission unit and the ultrasonic wave from the ultrasonic wave transmission unit 45 is transmitted to the recording material P. When the ultrasonic wave is transmitted, the amplification unit and the A/D conversion unit start operating and the voltage signal from the ultrasonic wave receiving unit 46 is subjected to the operation processing. The instruction signal Idm is turned OFF after 0.3 ms and accordingly, the operations of the amplification unit and the A/D conversion unit are stopped. When the instruction signal Idm is turned off, the instruction signal Ids from the surface texture detection control unit is turned on after 0.1 ms.

Accordingly, the CMOS area sensor 53 and the A/D conversion unit (A) start operating to detect the surface texture during 1 ms period. 2.5 ms after a first instruction signal Idm from the basis weight detection control unit is turned on, a second instruction signal Idm is turned on to perform a second basis weight detection operation. In the present exemplary embodiment, as a means for avoiding the effect of the reverberation, both of the amplification operation and the A/D conversion output of the ultrasonic wave-system recording material determination device 40 are stopped. However, only one of them may be stopped depending on a state of a noise level actually observed. In the present exemplary embodiment, an operation in which the detection according to the ultrasonic wave system and the detection according to the optical system are made once respectively, is described. However, the respective detections may be performed for a plurality of times and the determination of the recording material P can be performed according to an average value thereof. The plurality of detections contributes to an enhancement of the accuracy of the obtainable output value, so that the determination accuracy of the recording material P can also be enhanced.

As described above, during a period of time after the detection by the ultrasonic wave-system recording material determination device 40 is made and before the reverberation of the ultrasonic wave is converged, a possible effect of the reverberation of the ultrasonic wave applied to the optical-system recording material determination device 50 can be suppressed by stopping the amplification operation and the A/D conversion. The detection by the optical-system recording material determination device 50 is performed by making use of the period of time until the reverberation of the ultrasonic wave is converged. As a result, a standby time until the reverberation of the ultrasonic wave is converged can be effectively used and thus the effective determination of the recording material P can be made.

In the first exemplary embodiment, a configuration that the ultrasonic wave-system recording material determination device 40 and the optical-system recording material determination device 50 are positioned adjacent to each other is described. In a second exemplary embodiment, a configuration that the ultrasonic wave-system recording material determination device 40 is combined with the optical-system recording material determination device 50 is described below. In the first exemplary embodiment, a state in which the detection operation of the optical-system recording material determination device 50 is performed by the area sensor is described. In the present exemplary embodiment, the detection operation of the optical-system recording material determination device 50 performed by the line sensor is described below. A detailed description of a configuration identical to that of the first exemplary embodiment is omitted here.

Figure 9:
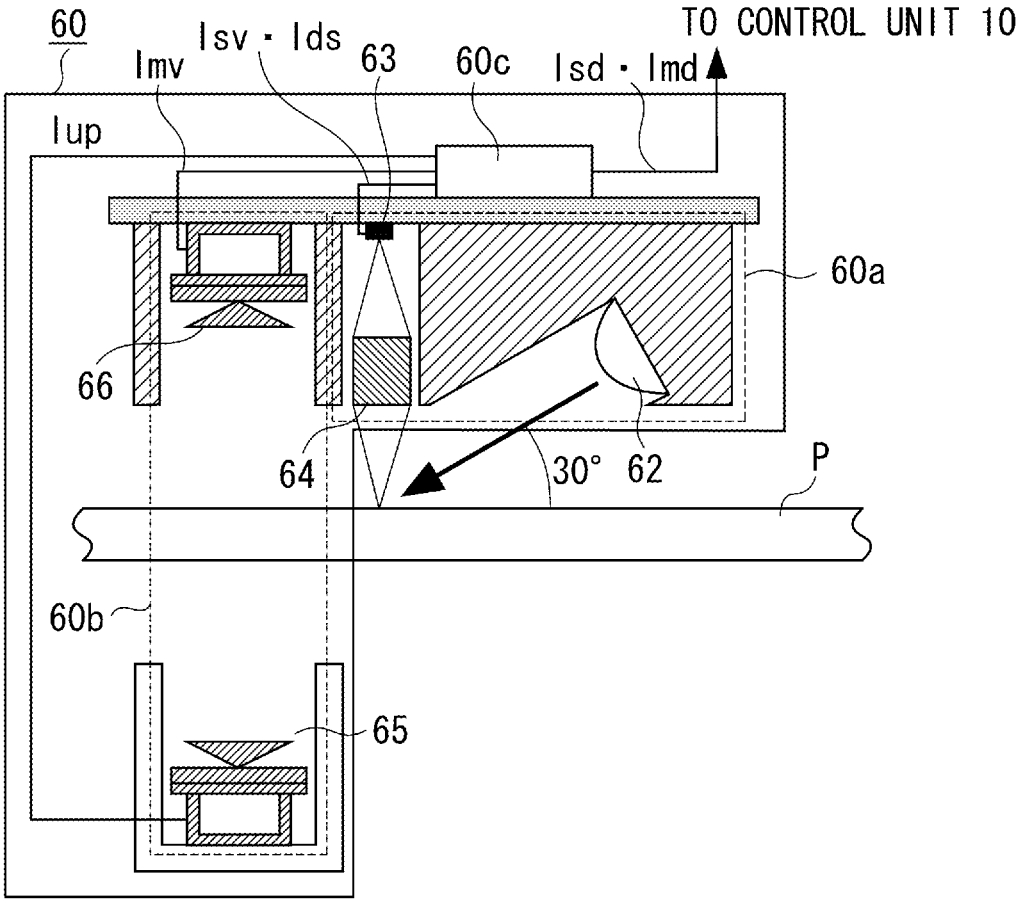
FIG. 9 illustrates a schematic configuration of a recording material determination device composed of a combination of the ultrasonic wave-system recording material determination device and the optical-system recording material determination device.

FIG. 9 illustrates a schematic configuration of the recording material determination device composed of a combination of the ultrasonic wave-system recording material determination device 40 and the optical-system recording material determination device 50. A recording material determination device 60 includes a surface detection unit 60*a* for detecting information which reflects a surface smoothness, a basis weight detection unit 60*b* for detecting information which reflects the basis weight, and a drive operation unit 60*c* for subjecting the output signals to the operation processing as well as driving the above two detection units.

The surface detection unit 60*a* includes a reflective LED 62 as the light emission unit, a CMOS line sensor 63 as the image capturing unit, and an imaging lens 64 as the imaging unit . The reflective LED 62 as the light source emits light to the surface of the recording material P. The reflective LED 62 is positioned to emit light obliquely with a predetermined angle. In the present exemplary embodiment, as an example, the reflective LED 62 is positioned such that the angle made by the surface of the recording material P and the light exposure direction of the LED light becomes 30 degrees. The reflected light is concentrated via an imaging lens 64 to form an image onto the CMOS line sensor 63.

The basis weight detection unit 60*b* includes an ultrasonic wave transmission unit 65 and an ultrasonic wave receiving unit 66 which are spaced about 30 mm. When the drive pulse signal Iup is input from the drive operation unit 60*c*, an ultrasonic wave transmission unit 65 transmits an ultrasonic wave signal to the recording material P. The ultrasonic wave transmitted through the recording material P is received by an ultrasonic wave receiving unit 66. The ultrasonic wave transmission unit 65 is configured with a corn-shaped vibration board which is mounted to the bimorph oscillator to enhance the emission output.

Figure 10:
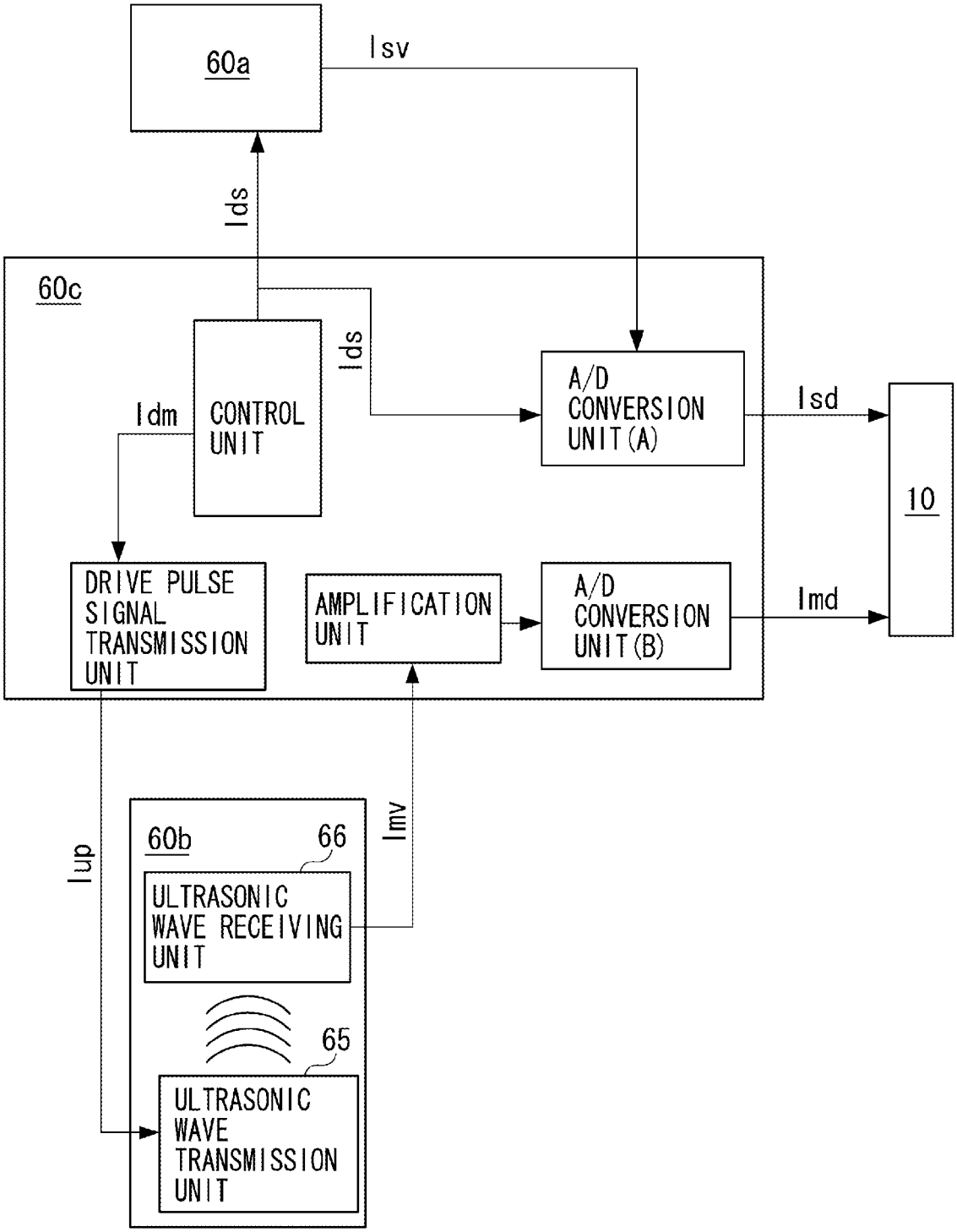
FIG. 10 is a block diagram illustrating a control system for controlling an operation of the recording material determination device.

FIG. 10 is an example of a block diagram illustrating a control system for controlling an operation of the recording material determination device 60. When the instruction signal Ids from the drive operation unit 60*c* is turned on, the CMOS line sensor 63 outputs the voltage video signal Isv that changes in response to the reflected light amount for each area where an image is formed. When the drive operation unit 60*c* receives the voltage video signal Isv output from the CMOS line sensor 63, the drive operation unit 60*c* A/D-converts it and thus converted digital signal Isd is output to the control unit 10 with a transfer rate of 48 MHz.

The image forming apparatus repeats an image capturing operation by the CMOS line sensor 63 while the recording material P is moved in a conveyance direction. The control unit 10 generates area information by putting the voltage video signals Isv received from the CMOS line sensor 63 together. The CMOS line sensor 63, used in the present exemplary embodiment as an example, is 20 mm in an effective pixel length (in a longitudinal direction) and 600 dpi in resolution, so that the surface information of the recording material P having a size of 6 mm in a longitudinal length and 20 mm in a horizontal length can be acquired. The size of the surface information can be changed, if required, by changing the image capturing operation performed by the CMOS line sensor 63. Then, during a period of time after the instruction signal Ids is turned off and before the instruction signal Ids is subsequently turned on, an output of the digital signal Isd is stopped. The control unit 10 identifies the surface condition of the recording material P by analyzing the received digital signal Isd as video.

Since the operation of the basis weight detection unit 60*b* is identical to that of the above described first exemplary embodiment illustrated in FIG. 3, a detailed description thereof is omitted here. The recording material determination device 60 is configured such that the surface detection unit 60*a* is combined with the basis weight detection unit 60*b* to achieve the downsizing. The voltage output information detected by both of the detection units are collectively processed by the drive operation unit 40*c*. Therefore, similar to the first exemplary embodiment, the voltage output of the one of the detection units may generate a noise in the voltage output of the other one of the detection units, so that the determination accuracy of the recording material P can be degraded. In the present exemplary embodiment, when the basis weight detection unit 60*b* performs a basis weight detection operation by the ultrasonic wave, the driving pulse signal Iup is output from the drive operation unit 60*c*. Subsequently, the amplification operation and the operation of the A/D conversion unit (B) are stopped after predetermined time (0.3 ms) has elapsed to detect the surface texture of the recording material P during the suspended time.

Figure 11:
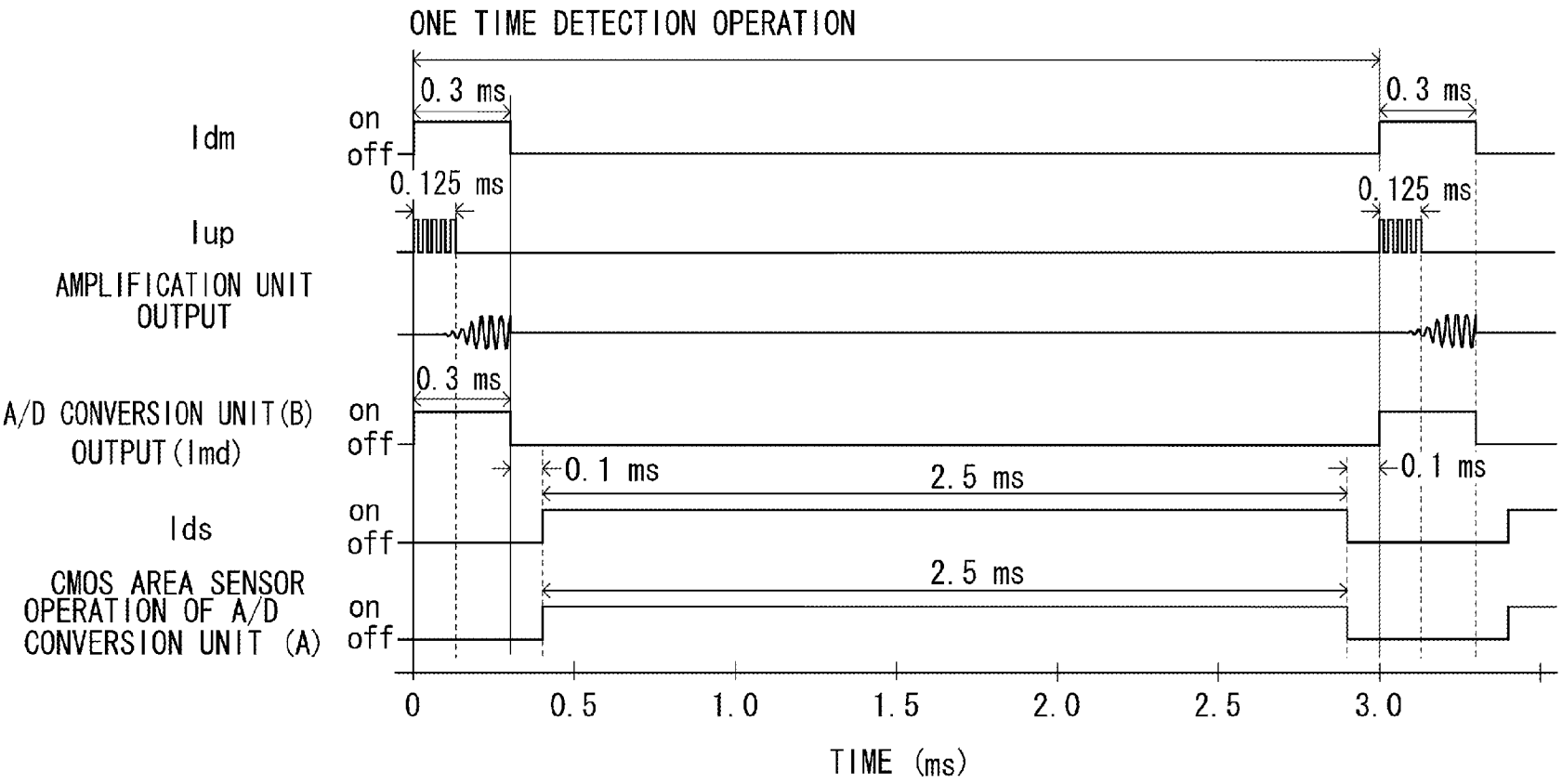
FIG. 11 is a timing chart illustrating timings of the detection operation performed by the recording material determination device.

Timings of the detection operation performed by the recording material determination device 60 are described below with reference to a timing chart of FIG. 11. When the instruction signal Idm from the basis weight detection control unit is turned on, 5 waves (for a period of about 0.125 ms) of the drive pulse signal Iup at 40 KHz are output from the drive pulse signal oscillating unit and the ultrasonic wave from the ultrasonic wave transmission unit 65 is transmitted to the recording material P. When the ultrasonic wave is transmitted, the amplification unit and the A/D conversion unit start to perform processing with respect to the voltage signal from the ultrasonic wave receiving unit 66, and outputs the digital signal Imd. The instruction signal Idm is turned off after 0.3 ms, which stops the operations of the amplification unit and the A/D conversion unit.

When the instruction signal Idm is turned off, the instruction signal Ids from the surface texture detection control unit is turned on after 0.1 ms. Accordingly, the CMOS line sensor 63 and the A/D conversion unit (A) start the operations and the surface texture detection is performed for 2.5 ms. The recording material P is conveyed at a speed of 200 mm/s by a conveyance roller pair. In the detection operation of the surface texture for 2.5 ms, the CMOS line sensor 63 captures an image of a surface image of an area of 0.5 mm×20 mm since the recording material P moves by 0.5 mm. After 3 ms since the instruction signal Idm from the basis weight detection control unit is turned on (i.e., after 0.1 ms since an end of the surface texture detection), a second instruction signal Idm is turned on and a second basis weight detection operation is performed.

In the present second exemplary embodiment, as a means for avoiding an effect of the reverberation, both of the amplification operation and the A/D conversion output of the ultrasonic wave-system recording material determination device 40 are stopped; however, a control may be performed such that only one of them is stopped depending on a condition of a noise level actually observed. An operation that the ultrasonic wave-system detection and the optical-system detection are performed once respectively, is described here. However, the detections may be performed for a plurality of times to make a determination of the recording material P using an average value thereof. Since the accuracy of the obtainable output value is enhanced according to the plurality of detections, the determination accuracy of the recording material P also can be enhanced.

As described above, in the configuration that the ultrasonic wave-system recording material determination device 40 is combined with the optical-system recording material determination device 50, the possible effect of the reverberation of the ultrasonic wave on the optical-system recording material determination device 50 can be suppressed by stopping the amplification operation and the A/D conversion until the reverberation of the ultrasonic wave converges. Further, a standby time until the reverberation of the ultrasonic wave converges can be effectively used by making the detection by the optical-system recording material determination device 50 using the time until the reverberation of the ultrasonic wave converges. As a result, an effective determination of the recording material P can be made.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-162775 filed Jul. 20, 2010, which is hereby incorporated by reference herein in its entirety.

What is claimed is:

1. A recording material determination device comprising:

an ultrasonic wave transmission unit configured to transmit an ultrasonic wave a plurality of times to a recording material;

an ultrasonic wave receiving unit configured to receive the ultrasonic wave transmitted via the recording material after the ultrasonic wave is transmitted by the ultrasonic wave transmission unit and output a first signal and a second signal corresponding to the ultrasonic wave received by the ultrasonic wave receiving unit;

a processing unit configured to perform processing with respect to the first signal and the second signal output by the ultrasonic wave receiving unit;

a light emission unit configured to emit light to the recording material;

a light receiving unit configured to receive light emitted by the light emission unit via the recording material and output a third signal corresponding to the received light; and a control unit configured to determine a basis weight of the recording material based on a result obtained by performing processing with respect to the first signal and the second signal by the processing unit, and respectively correspond to a first ultrasonic wave transmitted by the ultrasonic wave transmission unit to the recording material and received by the ultrasonic wave receiving unit via the recording material, and a second ultrasonic wave transmitted by the ultrasonic wave transmission unit to the recording material to which the first ultrasonic wave is transmitted, and received by the ultrasonic wave receiving unit via the recording material to which the first ultrasonic wave is transmitted, and determine a surface condition of the recording material based on the third signal which is output by the light receiving unit and corresponds to light emitted by the light emission unit to the recording material and received by the light receiving unit via the recording material, wherein, during a first period of time that is after the ultrasonic wave transmission unit starts transmitting the first ultrasonic wave and before the processing unit stops performing processing with respect to the first signal, the light receiving unit doesn't output the third signal, and during a second period of time that is after the processing unit stops performing processing with respect to the first signal and before the ultrasonic wave transmission unit starts transmitting the second ultrasonic wave, the light receiving unit outputs the third signal.

2. An image forming apparatus comprising:

an image forming unit configured to form an image on a recording material;

an ultrasonic wave transmission unit configured to transmit an ultrasonic wave a plurality of times to the recording material;

an ultrasonic wave receiving unit configured to receive the ultrasonic wave transmitted via the recording material after the ultrasonic wave is transmitted by the ultrasonic wave transmission unit and output a first signal and a second signal corresponding to the ultrasonic wave received by the ultrasonic wave receiving unit;

a processing unit configured to perform processing with respect to the first signal and the second signal output by the ultrasonic wave receiving unit;

a light emission unit configured to emit light to the recording material;

a light receiving unit configured to receive light emitted by the light emission unit via the recording material and output a third signal corresponding to the received light; and a control unit configured to control an image forming condition of the image forming unit with respect to the recording material based on a result obtained by performing processing with respect to the first signal and the second signal by the processing unit;

the first signal and the second signal which are output by the ultrasonic wave receiving unit and respectively correspond to a first ultrasonic wave transmitted by the ultrasonic wave transmission unit to the recording material and received by the ultrasonic wave receiving unit via the recording material, and a second ultrasonic wave transmitted by the ultrasonic wave transmission unit to the recording material to which the first ultrasonic wave is transmitted, and received by the ultrasonic wave receiving unit via the recording material to which the first ultrasonic wave is transmitted, and control the image forming condition based on the third signal which is output by the light receiving unit and corresponds to light emitted by the light emission unit to the recording material and received by the light receiving unit via the recording material, wherein, during a first period of time that is after the ultrasonic wave transmission unit starts transmitting the first ultrasonic wave and before the processing unit stops performing processing with respect to the first signal, the light receiving unit doesn't output the third signal, and during a second period of time that is after the processing unit stops performing processing with respect to the first signal and before the ultrasonic wave transmission unit starts transmitting the second ultrasonic wave, the light receiving unit outputs the third signal.

3. The recording material determination device according to claim 1, wherein at a time point when a predetermined time passes from when the ultrasonic wave transmission unit starts transmitting the first ultrasonic wave, the ultrasonic wave transmission unit stops transmitting the first ultrasonic wave, and wherein, during the ultrasonic wave transmission unit receiving an ultrasonic wave via the recording material after the ultrasonic wave transmission unit stops transmitting the first ultrasonic wave, the processing unit stops performing processing with respect to the first signal.

4. The recording material determination device according to claim 1, further comprising:

an amplification unit configured to amplify the first signal and the second signal output by the ultrasonic wave receiving unit, wherein the first period is a period after the ultrasonic wave transmission unit starts transmitting the first ultrasonic wave and before the amplification unit stops amplifying the first signal, and the second period is a period after the amplification unit stops amplifying the first signal and before the ultrasonic wave transmission unit starts transmitting the second ultrasonic wave.

5. The recording material determination device according to claim 1:

wherein the processing unit comprising a signal conversion unit configured to convert the first signal and the second signal output by the ultrasonic wave receiving unit into a digital signal, and wherein the first period is a period after the ultrasonic wave transmission unit starts transmitting the first ultrasonic wave and before the signal conversion unit stops converting the first signal, and the second period is a period after the signal conversion unit stops converting the first signal and before the ultrasonic wave transmission unit starts transmitting the second ultrasonic wave.

6. The recording material determination device according to claim 1, wherein the ultrasonic wave transmission unit transmits an ultrasonic wave a plurality of times to a recording material being conveyed, and the ultrasonic wave receiving unit receives the ultrasonic wave transmitted by the ultrasonic wave transmission unit via the recording material being conveyed and outputs the first signal and the second signal corresponding to the received ultrasonic wave, and wherein the light emission unit emits light to the recording material being conveyed, and the light receiving unit receives light emitted by the light emission unit via the recording material being conveyed and outputs the third signal corresponding to the received light.

7. The image forming apparatus according to claim 2, wherein at a time point when a predetermined time passes from when the ultrasonic wave transmission unit starts transmitting the first ultrasonic wave, the ultrasonic wave transmission unit stops transmitting the first ultrasonic wave, and wherein, during the ultrasonic wave transmission unit receiving an ultrasonic wave via the recording material after the ultrasonic wave transmission unit stops transmitting the first ultrasonic wave, the processing unit stops performing processing with respect to the first signal.

8. The image forming apparatus according to claim 2, wherein the processing unit comprising an amplification unit configured to amplify the first signal and second signal output by the ultrasonic wave receiving unit, and wherein the first period is a period after the ultrasonic wave transmission unit starts transmitting the first ultrasonic wave and before the amplification unit stops amplifying the first signal, and the second period is a period after the amplification unit stops amplifying the first signal and before the ultrasonic wave transmission unit starts transmitting the second ultrasonic wave.

9. The image forming apparatus according to claim 2, wherein the processing unit comprising a signal conversion unit configured to convert the first signal and the second signal output by the ultrasonic wave receiving unit into a digital signal, and wherein the first period is a period after the ultrasonic wave transmission unit starts transmitting the first ultrasonic wave and before the signal conversion unit stops converting the first signal, and the second period is a period after the signal conversion unit stops converting the first signal and before the ultrasonic wave transmission unit starts transmitting the second ultrasonic wave.

10. The image forming apparatus according to claim 2, further comprising:

a conveyance unit configured to convey a recording material, wherein the ultrasonic wave transmission unit transmits an ultrasonic wave a plurality of times to a recording material being conveyed by the conveyance unit, and the ultrasonic wave receiving unit receives the ultrasonic wave transmitted by the ultrasonic wave transmission unit via the recording material being conveyed and outputs the first signal and the second signal corresponding to the received ultrasonic wave, and wherein the light emission unit emits light to the recording material being conveyed, and the light receiving unit receives light emitted by the light emission unit via the recording material being conveyed and outputs the third signal corresponding to the received light.

11. The image forming apparatus according to claim 2, wherein the image forming condition is a temperature of a fixing unit included in the image forming unit.

12. The recording material determination device according to claim 1, further comprising:

a driving signal transmission unit configured to transmit to the ultrasonic wave transmission unit a driving signal for causing the ultrasonic wave transmission unit to transmit an ultrasonic wave, wherein the first period is a period after the driving signal transmission unit transmits a first driving signal for causing the ultrasonic wave transmission unit to transmit the first ultrasonic wave and before the processing unit stops performing processing with respect to the first signal, and the second period is a period after the processing unit stops performing processing with respect to the first signal and before the driving signal transmission unit transmits a second driving signal for causing the ultrasonic wave transmission unit to transmit the second ultrasonic wave.

13. The image forming apparatus according to claim 2, further comprising:

a driving signal transmission unit configured to transmit to the ultrasonic wave transmission unit a driving signal for causing the ultrasonic wave transmission unit to transmit an ultrasonic wave, wherein the first period is a period after the driving signal transmission unit transmits a first driving signal for causing the ultrasonic wave transmission unit to transmit the first ultrasonic wave and before the processing unit stops performing processing with respect to the first signal, and the second period is a period after the processing unit stops performing processing with respect to the first signal and before the driving signal transmission unit transmits a second driving signal for causing the ultrasonic wave transmission unit to transmit the second ultrasonic wave.

14. The recording material determination device according to claim 1, wherein a first circuit connected with the ultrasonic wave transmission unit, the ultrasonic wave receiving unit and the processing unit, and a second circuit connected with the light emission unit and the light receiving unit are adjacently arranged.

15. The image forming apparatus according to claim 2, wherein a first circuit connected with the ultrasonic wave transmission unit, the ultrasonic wave receiving unit and the processing unit, and a second circuit connected with the light emission unit and the light receiving unit are adjacently arranged.

* * * * *